United States Patent [19]

Chervonenko et al.

[11] Patent Number: 4,879,024

[45] Date of Patent: Nov. 7, 1989

[54] ELASTOMERIC ELEMENT FOR FORMING SURFACES ENGAGEABLE WITH LOOSE ABRASIVE MATERIALS, AND A SIZING SCREEN MADE FROM SUCH ELEMENTS

[75] Inventors: Alfred G. Chervonenko; Vladimir P. Naduty; Vladimir L. Morus; Valery I. Kravchenko; Viktor A. Lavrukhin, all of Dnepropetrovsk, U.S.S.R.

[73] Assignee: Institut Geotekhnicheskoj Mekhaniki, Dnepropetrovsk, U.S.S.R.

[21] Appl. No.: 173,377

[22] Filed: Mar. 25, 1988

[51] Int. Cl.[4] ..... B07B 1/04

[52] U.S. Cl. ..... 209/352; 209/392; 209/397; 209/399

[58] Field of Search ..... 209/397, 399352, 392, 209/393, 931

[56] References Cited

U.S. PATENT DOCUMENTS 1,544,494 6/1925 Spoehr et al. ..... 209/399
3,970,550 7/1976 Fry et al. ..... 209/399
4,374,169 2/1983 Gryskiewicz et al. ..... 209/392 X
4,383,919 5/1983 Schmidt et al. ..... 209/931 X

FOREIGN PATENT DOCUMENTS 1155305 5/1985 U.S.S.R. ..... 201/392

*Primary Examiner*—Johnny D. Cherry
*Assistant Examiner*—Gary C. Hoge
*Attorney, Agent, or Firm*—Burgess, Ryan & Wayne

[57] ABSTRACT

An elastomeric element for forming surfaces engageable with loose abrasive materials comprising a base having a working surface in the form of a surface of revolution. In a section taken perpendicularly to the axis of the surface of revolution the base is fashioned as a sector of a ring. A sizing screen from the elastomeric elements has secured on a frame thereof a plurality of elastomeric elements with a plurality of holes made therein. Each elastomeric element is secured by the attachment means on the frame of the sizing screen to form a substantially flat working surface.

4 Claims, 1 Drawing Sheet

ELASTOMERIC ELEMENT FOR FORMING SURFACES ENGAGEABLE WITH LOOSE ABRASIVE MATERIALS, AND A SIZING SCREEN MADE FROM SUCH ELEMENTS

This invention relates generally to an apparatus for preparing and processing loose abrasive materials, and more particularly, to an elastomeric element for forming surfaces engageable with loose abrasive materials, and a sizing screen made from such elements.

FIELD OF THE INVENTION

The invention can find application in mining, metallurgy, and in the industry concerned with construction materials. The invention can be used most advantageously in an apparatus for grading or sizing loose abrasive materials in processes associated with dry or wet screening. The proposed elastomeric elements can also be successfully used as a lining in devices for crushing or comminuting a range of loose abrasive materials, such as ores of ferrous and non-ferrous metals or basic materials for the construction industry.

BACKGROUND OF THE INVENTION

At present, operation of devices engageable with loose abrasive materials, such as sizing screens, conveyers, and ore processing machines, poses a major problem for extending the service life and reducing the wear of surfaces subjected to vigorous action of loose abrasive materials.

Elements from elastomers (such as rubber or polyurethane) used for such purposes are characterized by low resistance to wear and short service life. This is due to the fact that in most such devices the elastomeric elements forming the surface engageable with loose abrasive materials are normally mounted with a tension or strain resulting in fast wear of their working surfaces, low resistance to rupture, and tendency of crack formation.

There is known a sifting element of a screening surface (cf., Catalogue of the swedish company "Trelleborg", pp. 21 and 27) comprising a base with a plurality of through holes made up of two or more layers of elastomer having different mechanical characteristics, or made of a single layer and reinforced with a cord element or special metal inserts. The top layer forming the working surface of the element is fabricated from a soft wear-resistant rubber, whereas the other successive layers are made of a more rigid rubber or polyurethane.

There are also known grading screens "Duenero", "DUO", "Trelleborg", "Treliflex" (cf., Catalogue of the swedish company "Trelleborg", pp. 21 and 27) with frames thereof accommodating a plurality of the aforedescribed sifting elements. Such screens are very resistant to wear, but have a rather intricate structural arrangement of these elements.

There is known an elastic sifting element of a sizing screen (cf., SU, A, 1,039,587) comprising a flat base with a plurality of holes and stiffening ribs, and a sizing screen including a frame having secured thereto a plurality of said elastic sifting elements. The elastic sifting elements are secured with a tension on the frame of the screen to form a working surface subjected to intensive wear during engagement with loose abrasive materials which reduces the service life of the sizing screen.

In addition, stretching of the elastic sifting elements cause deformation and change in the size of the holes, as well as an increase in the clearances between the adjacent elastic sifting elements to a magnitude exceeding the maximum allowable grading size, which reduces the efficiency of screening.

There is also known an elastomeric element for forming surfaces engageable with loose abrasive materials (cf., SU, A, 1,080,885) comprising a base having a working surface engageable with loose abrasive materials, and at least two attachment means connected to the base. The base of the element is fashioned as a flat belt having wedge-shaped recesses spaced equidistantly along one edge. The two attachment elements are provided at the ends of the base for the base to be mounted with tension in the frame of the sizing screen.

There is further known a sizing screen for grading loose abrasive materials according to size (cf., SU, A 1,080,885) comprising a frame having secured thereon a plurality of sifting elements forming a surface engageable with loose abrasive materials. The surface of the sizing screen engageable with the loose abrasive materials is formed from the above elements secured in the frame of the screen so that the edge with projections of the preceding belt adjoins the straight edge of the succeding belt to form holes for the passage of the fine fraction of the loose abrasive materials.

The sifting elements are mounted in the frame of the sieve with a relative tension of 25–30%. As is known, for elastomers in such a strained state, the wear due to engagement with loose abrasive materials is almost doubled. Therefore, screens made up of such known elastomeric elements have a rather short service life.

SUMMARY OF THE INVENTION

It is therefore an object of the present invention to provide an elastomeric element for forming surfaces engageable with loose abrasive materials featuring a higher resistance to wear.

Another object is to provide a sizing screen for grading loose abrasive materials to size having a longer service life.

The object of the invention is attained by providing an elastomeric element for forming surfaces engageable with loose abrasive materials comprising a base having a working surface engageable with loose abrasive materials, and at least two attachment means connected to the base, according to the invention, the working surface of the base is fashioned as a surface of revolution, whereas the base per se in a section perpendicular to the axis of the surface of revolution has the shape of a sector of a ring.

The object of the invention is also attained by providing a sizing screen for grading loose abrasive materials comprising a frame having secured thereon a plurality of sifting elements forming a surface engageable with loose abrasive materials, according to the invention, each elastomeric sifting element includes a base having a working surface for engaging with loose abrasive materials in the form of a surface of revolution connected to at least two attachment means. The base per se in a section perpendicular to the axis of the surface of revolution, has the form of a sector of a ring and also has a plurality of holes. Each elastomeric sifting element being secured in the frame by attachment means at ends of the base of the sector of the ring to form a substantially flat working surface.

The proposed elastomeric element for forming surfaces engageable with loose abrasive materials features a high resistance to wear and a long service life. Such elements can be used as a lining in various installations, and also as sifting elements of sizing screens. The elastomeric elements according to the invention are installed in units and screens so that layers of the elements, engageable with loose abrasive materials (working surfaces), are not subjected to tensile stress. This in turn reduces the wear of the proposed elements and almost doubles their service life.

In addition, the proposed arrangement ensures more efficient grading and screening of loose abrasive materials since grading to size is not influenced by variations in the geometric dimensions of holes in the sifting elements of the sizing screen.

BRIEF DESCRIPTION OF THE DRAWINGS

The invention will now be described in greater detail with reference to specific preferred embodiments thereof taken in conjunction with the accompanying drawings, in which.

DETAILED DESCRIPTION OF THE INVENTION

Figure 1:
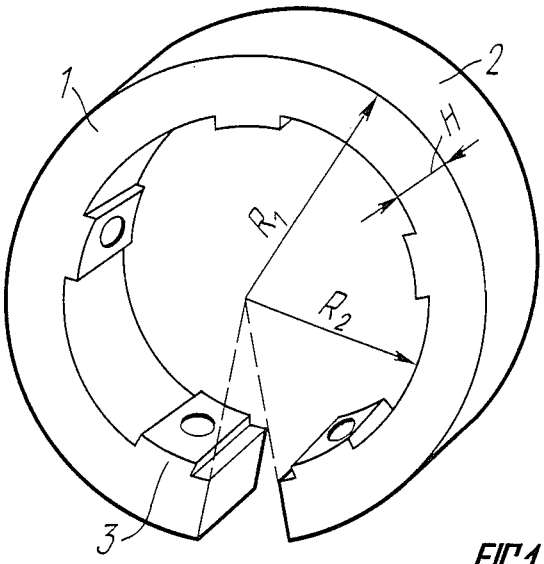
FIG. 1 is an axonometric view of an elastomeric element for forming surfaces engageable with loose abrasive materials according to the invention.

An elastomeric element for forming surfaces engageable with loose abrasive materials comprises a base 1 (FIG. 1) having a working surface 2 for engaging with loose abrasive materials fashioned as a surface of revolution. In the herein discussed embodiment the working surface 2 is cylindrical. In a section perpendicular to the axis of the surface of revolution the base 1 has the form of a sector of a ring. Provided at the inner side of the base 1 are at least two attachment means 3. In the embodiment herein described there are five attachment means in the form of projections with holes made integral with the base 1 of the element.

At a given relative tensile strain $/\epsilon/$ of the inner layers of the base 1, the length $L_1$ (not shown) of the working surface 2 of the base 1 about an arc of the outer radius $R_1$ of the sector of a ring is determined from:

$$L_1 = L_2 + L_2/\epsilon/, \quad (1)$$

where $L_2$ is the length (not shown) of non-working surface of the base 1 about an arc of the inner radius $R_2$.

At a specified thickness H of the base 1 for meeting these conditions the radius $R_1$ is determined from:

$$R_1 = \frac{2H(1 + |\epsilon|)}{|\epsilon|} \quad (2)$$

In other alternative embodiments of the elastomeric element the working surface 2 can be conical, parabolic, or the like, whereas its shape is determined by the required shape of the surface engageable with loose abrasive materials. Referring now to FIG. 2, a sizing screen for grading the loose abrasive materials according to size comprises a frame 4 having attached thereto a plurality of sifting elements forming a surface engageable with the loose abrasive materials. The sifting elements are elastomeric elements fashioned substantially as one shown in FIG. 1, the base 1 includes a plurality of holes 5 having the maximum width corresponding to the desired size grading of the loose abrasive materials.

Each sifting element is secured in the frame 4 of the screen by two clamping means 6 at the ends of the base 1 of the sector of a ring (shown by dotted lines in FIG. 1) and having the form of thickened portions made integral with the base 1 of the sifting element. When the elastomeric element is mounted in the frame 4, a substantially flat working surface 7 of the element is formed. The elastomeric element is straightened and secured by the attachment means 6 with a predetermined relative deformation $/\epsilon/$ such that the working surface 7 is flattened and is not subjected to tensile stress. In the absence of tensile stress at the working surface 7, the size of the hole 5 remains invariable, which facilitates grading of the loose abrasive materials according to the specified size.

OPERATION

Figure 2:
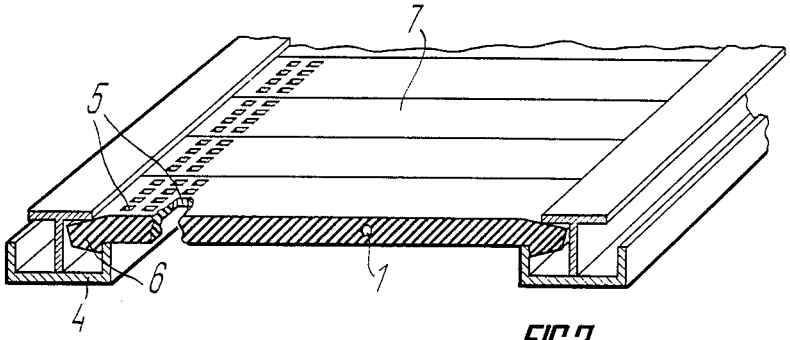
FIG. 2 is an axiometric view of the sizing screen making use of elements of the invention with a section taken along the frame of the screen.

A sizing screen for grading loose abrasive materials according to size fabricated from elastomeric elements, as shown in FIG. 1, and FIG. 2 operates in the following manner.

As the loose abrasive material falls onto the flat working surface 7 (FIG. 2) formed by the elastomeric elements secured in the frame 4 of the screen by the attachment means 6, the working surface is subjected to impacts exerted by the particles of loose abrasive material thereon. Fine particles of the loose abrasive material pass through the holes 5 of the base 1, whereas larger size particles tend to collect at the working surface 7 according to the predetermined size. Since the working surface 7 is not subject to tensile stress, the holes 5 fail to change their size and ensure grading of the loose abrasive material according to the specified size. This makes the working surface 7 more resistant to wear, rupture and crack formation.

In view of the aforedescribed, the sizing screen made from the proposed elastomeric elements has a longer service life, and is more reliable in operation.

What is claimed is:

1. An elastomeric element for forming a surface engageable with loose abrasive materials comprising:

(a) a base having two ends and a working surface, to engage loose abrasive materials, in the form of a surface of revolution having an axis; said base in a section perpendicular to the axis of said surface of revolution, having the form of a sector of a ring; and (b) at least two attachment means connected to said base in a configuration to provide absence of tension in the surface engageable with the abrasive material when the element is mounted.

2. A sizing screen for grading loose abrasive materials comprising:

(a) a frame;

(b) a plurality of elastomeric sizing elements secured on said frame, the sizing elements comprising:

a base having two ends and a working surface to engage the loose abrasive materials, the base is in the form of a surface of revolution having an axis;

said base, in a section perpendicular to the axis of said surface of revolution having the form of a sector of a ring;

(c) attachment means to mount each of said elastomeric elements in said frame, disposed at said ends of said base; and (d) a plurality of holes in each base with the maximum dimension of each hole corresponding to the grading size of the loose abrasive material.

3. An elastomeric element of claim 1, wherein the base has two ends, at the edges of the sector of the ring, and at least one attachment means disposed near each end.

4. An elastomeric element of claim 3, wherein the base comprises a plurality of holes.

* * * * *